United States Patent [19]

Stover

[11] Patent Number: 4,791,742

[45] Date of Patent: Dec. 20, 1988

[54] TRACTOR FEED PLANT LABELS

[75] Inventor: Gary L. Stover, Ormond Beach, Fla.

[73] Assignee: Economy Label Sales Co., Inc., Daytona Beach, Fla.

[21] Appl. No.: 50,339

[22] Filed: May 18, 1987

[51] Int. Cl.[4] ..... G09F 3/100

[52] U.S. Cl. ..... 40/299; 281/2; 283/21

[58] Field of Search ..... 40/2 R, 10 C; 24/30.55, 24/237, 703; 281/2, 5; 283/81

[56] References Cited

U.S. PATENT DOCUMENTS

| | | | |
|---|---|---|---|
| 478,185 | 7/1892 | Barnum | 40/10 C |
| 1,863,608 | 6/1932 | Stewart | 40/10 C |
| 2,113,455 | 4/1938 | Sherman | 400/616 |
| 2,642,684 | 6/1953 | Watts | 40/10 C |
| 2,787,435 | 4/1957 | Shields | 24/237 |
| 3,164,250 | 1/1965 | Paxton | 24/30.5 X |
| 3,541,728 | 11/1970 | Thon et al. | 40/10 C |
| 3,775,882 | 12/1973 | Wheeler | 40/10 C |
| 4,570,368 | 2/1986 | Stover | 40/10 C |

FOREIGN PATENT DOCUMENTS

| | | | |
|---|---|---|---|
| 1454512 | 10/1966 | France | 40/10 C |

*Primary Examiner*—Gene Mancene
*Assistant Examiner*—Michael Lynch
*Attorney, Agent, or Firm*—Macdonald J. Wiggins

[57] ABSTRACT

An elongated plant labeling tag has an opening adjacent a first end of encircling the stem of a plant. A notch in the first end has a slit projecting toward the opening leaving a thin web between the slit and the opening. A plurality of such tags are lightly attached along the longitudinal edges thereof and provided with sprocket holes along the lateral edges thereof to permit printing of the tags in a tractor feed printer; the web functioning to prevent lifting of portions of the tag from the printer platen which causes jamming of the tractor feed.

5 Claims, 1 Drawing Sheet

TRACTOR FEED PLANT LABELS

BACKGROUND OF THE INVENTION

1. Field of the Invention

The present invention relates to labeling tags for plants, and more particularly to labeling tags in a configured to permit printing thereof utilizing a tractor feed printer.

2. Description of the Prior Art

It is common to label plants in nurseries, gardens and the like with small, elongate labels which are attached to a stem of the plant. Such labeling tags are generally made from a thin, stiff treated cardboard or plastic material and may include an opening punched at a first end. Such labels are wrapped around the plant stem and a second end inserted through the opening in the opposite first end with notches along a longitudinal edge to secure the labeling tag once it is attached. To minimize the time required to attach such labeling tags to plants in nurseries where large numbers of plants must be labeled, a labeling tag has been developed which has a hole punched in one end thereof of a size to encircle the largest stem desired with a split or slot extending from the outer edge of the tag into the hole. With this style of tag, the user grasps the tag adjacent the hole and pushes the stem into the opening via the slot. Thus, this style labeling tag can be attached to a plant very quickly.

In many large nurseries, it is necessary to print identification information on a large number of labeling tags. Therefore, it is known to prepare rolls of tags lightly joined along longitudinal edges such that they can be fed through a tractor feed printer by means of sprocket holes. While this technique is satisfactory on some types of tags, the preferred split end type labeling tag is found to have a tendency to hang up in the printer due to the split at one end. This problem is due to the tendency for the split portion to lift off of the printer platen as the tag traverses the cylindrical platen.

Thus, there is a need for a plant labeling tag which can be quickly attached to a plant and which can be fed through a tractor feed printer.

SUMMARY OF THE INVENTION

The present invention is an elongate plant labeling tag having an opening adjacent one end for encircling the stem of a plant. The tag end adjacent the opening includes a slit extending toward the opening and a notch. A small web exists between the inner end of the slit and the opening for the plant stem. The tags of the invention are provided to the user in a continuous strip having the longitudinal edges of each tag lightly attached to the longitudinal edge of the next tag so that the tags may be easily separated after printing. Each individual tag is provided with sprocket holes at each end and spaced for a standard tractor drive of a computer printer or the like. The tag is preferably formed from thin stiff cardboard or plastic material.

As will now be understood, a roll of such labeling tags may be fed through a tractor printer. The web between the end slit and the opening prevents any portions of a tag from lifting off of the platen in the printer mechanism and causing jamming as occurs with prior art tags. The web is easily broken when installing a tag onto a plant stem.

It is therefore a principal object of the invention to provide a plant labeling tag which can be provided in rolls having tractor feed perforations to permit rapid printing of multiple tags without the tag hanging up in the printer.

It is another object of the invention to provide an elongate, essentially rectangular plant labeling tag having sprocket holes at each end thereof and a punched opening in one end for attachment to the stem of a plant, access to such opening being provided by a slit with a web between the end of the slit and the opening, the web being easily broken when attaching the tag to a plant stem.

These and other objects and advantages of the invention will become apparent from the following detailed description when read in conjunction with the drawings.

DETAILED DESCRIPTION OF THE PREFERRED EMBODIMENT

Figure 1:
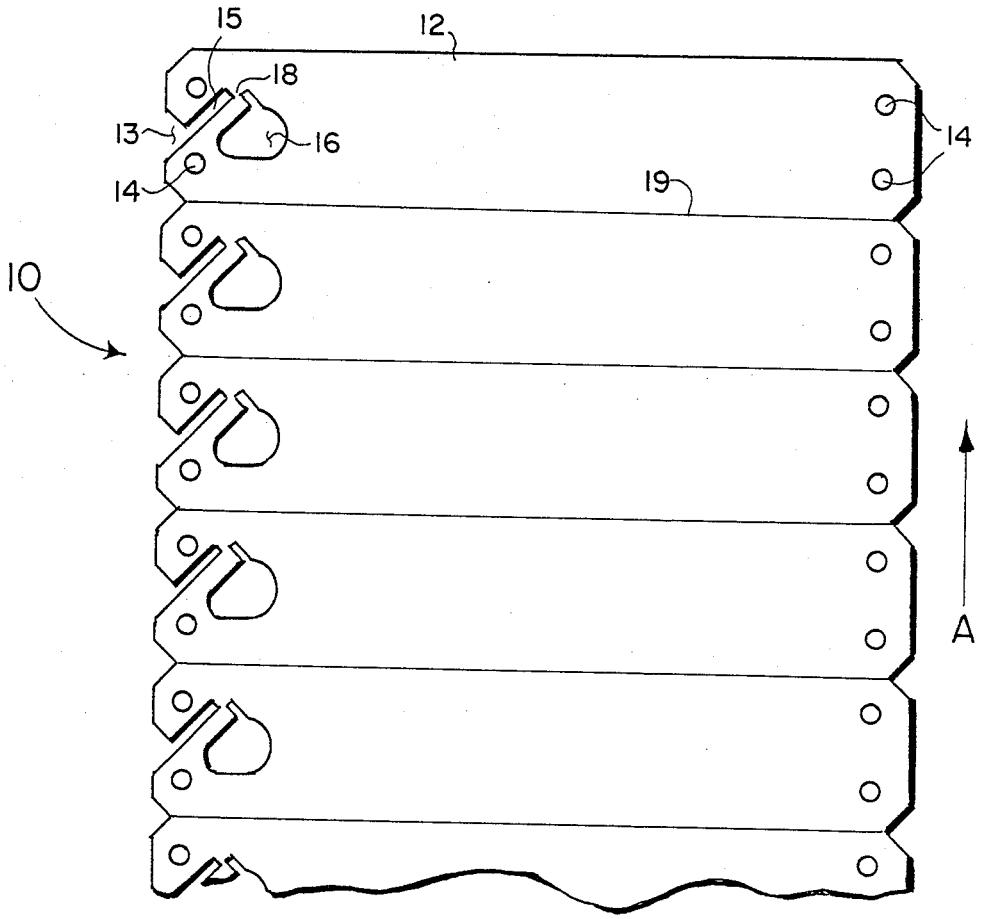
FIG. 1 illustrates a set of plant labeling tags of the invention lightly joined along the longitudinal edges thereof for printing in a tractor feed printing system.

Referring first to FIG. 1, a plan view of a strip of plant labeling tags 10 is shown, each joined to an adjacent tag by a partially cut line 19 such that the body 12 of one tag may be separated from the adjacent tag by bending and pulling the tags apart. The technique for forming such separable strips is well known in the art.

Each labeling tag includes a pair of sprocket holes 14 at each end thereof such that the spacing between sprocket holes 14 from tag to tag matches the drive sprockets of a tractor type printer. However, it is to be understood that the number of sprocket holes is determined by the width of the tag.

Figure 2:
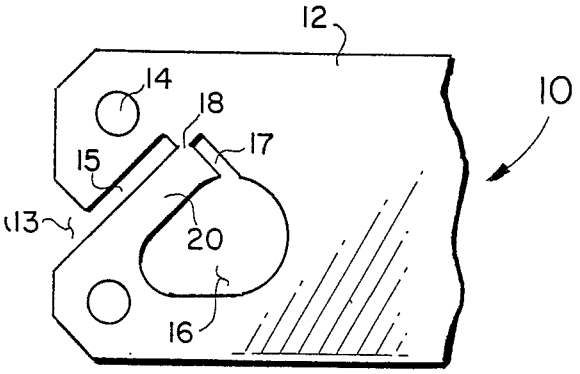
FIG. 2 shows a detail view of the end of a labeling tag of FIG. 1 having a plant opening, a lead-in slit and lead-out slit therein.

As is best seen in FIG. 2, each tag 10 has an opening 16 formed in one end thereof. Opening 16 is of a size to encircle the largest stem of a plant to which the tag is to be attached. A lead-out slit 17 is provided from opening 16. A lead-in slit 15 is provided extending from a guide notch 13 in the adjacent lateral edge of tag 10 toward lead-out slit 17, forming a narrow web 18 between slit 15 and slit 17.

Figure 3:
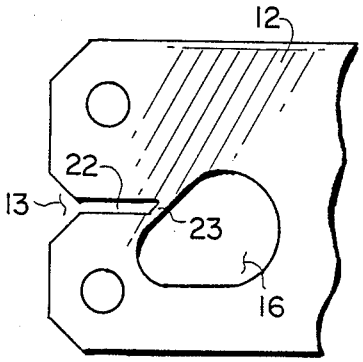
FIG. 3 is a detail view of an alternative arrangement of a lead-in slit.

Although the preferred embodiment of the invention utilizes a lead-in slit 15 at an approximate 45° angle with respect to the edges of tag body 12 and a lead-out slit 17 at approximately right angles to slit 15, a lead-in slit 22 parallel with the longitudinal edges of body 12, with a web 23 between the inner end thereof and opening 16, may be used as shown in FIG. 3.

As a labeling tag 10 is fed into a printer in the direction of arrow A of FIG. 1, it will be curled longitudinally around the platen. Web 18 holds tag portion 20 against the platen to thereby prevent tag portion 20 from lifting and hanging up in the printer feed mechanism. Advantageously, the combination of lead-in slit 15 and lead-out slit 17 at essentially right angles to each other resists any tendency of that portion of a tag to lift from the platen since any edges that could catch or hang up are rearward with respect to the direction of travel of the tags from a roll. When an individual tag 10 is to be attached to a plant, the user separates the tag 10 from the roll and pushes guide notch 13 against the stem with a slight twisting motion, causing web 18 to break and the plant stem to thereafter snap into opening 16.

It has been found that this construction permits a strip of plant labeling tags 10 to be automatically fed through a tractor drive printer or the like without the slits 15 and 17, and opening 16 causing tags to hang up and jamb the printer.

Although the preferred tag is a narrow rectangular style as shown in FIG. 1, it is clear that other forms of tags are equally suitable for use with the invention. Thus, the preferred embodiment is shown for exemplary purposes only and various changes can be made in the design thereof without departing from the spirit and scope of the invention.

I claim:

1. A plant labeling tag to permit feeding said tag through a printer without catching or snagging thereof and suitable for being supplied in a roll comprising:

an elongate body portion having a first and second end;

said first and second ends each having printer sprocket drive holes therethrough;

said first end having a plant stem attaching opening adjacent thereto;

a lead-in slit formed in said first end and extending from said first end toward said opening;

an easily broken web between an inner end of said lead-in slit and said opening; and means for lightly joining a plurality of said body portions to form said roll.

2. The tag as recited in claim 1 in which said first end includes a guide notch at an outer end of said lead-in slit.

3. A plurality of plant labeling tags in a roll comprising:

(a) a plurality of essentially rectangular tags, each of said tags having (i) a first end and a second end, each of said ends having sprocket holes therein for a tractor drive printer, (ii) said first end having an opening formed therethrough to fit a plant stem and spaced apart from a lateral outer edge of said tag, (iii) a lead-in slit extending from said lateral outer edge toward said opening, (iv) a lead-out slit extending from said opening toward said lead-in slit, and (v) a narrow web between an outer end of said lead-out slit and an inner end of said lead-in slit; and (b) means for lightly joining said plurality of tags along longitudinal edges thereof to form a roll, said sprocket holes spaced to permit feeding of said tags of said roll into a tractor feed printer.

4. The tags as recited in claim 3 in which each of said lateral outer edges of said first ends has a guide notch therein for guiding a plant stem into said lead-in slit.

5. The tags as recited in claim 3 in which each of said lead-in slits is at an angle with respect to said lead-out slit.

* * * * *